US006799581B2

(12) United States Patent
Cave

(10) Patent No.: US 6,799,581 B2
(45) Date of Patent: Oct. 5, 2004

(54) PONYTAIL HOLDER WITH LOW FRICTION INTERIOR PORTION

(75) Inventor: Sabrina Cave, Burlington, NJ (US)

(73) Assignee: L&N Sales and Marketing, Inc., Hatboro, PA (US)

( * ) Notice: Subject to any disclaimer, the term of this patent is extended or adjusted under 35 U.S.C. 154(b) by 0 days.

(21) Appl. No.: 10/254,166

(22) Filed: Sep. 25, 2002

(65) Prior Publication Data

US 2004/0055614 A1 Mar. 25, 2004

(51) Int. Cl.[7] ..... A45D 8/04; A45D 8/12
(52) U.S. Cl. ..... 132/273; 132/275
(58) Field of Search ..... 132/273, 275, 132/274; 2/171, 174

(56) References Cited

U.S. PATENT DOCUMENTS

| | | | | |
|---|---|---|---|---|
| 537,542 A | | 4/1895 | Moore | |
| 2,595,657 A | | 5/1952 | Harmon | 132/46 |
| 2,795,232 A | | 6/1957 | Klein | 132/57 |
| 4,499,741 A | | 2/1985 | Harris | 66/171 |
| 4,517,685 A | | 5/1985 | Lesley | 2/170 |
| 5,145,725 A | * | 9/1992 | Johnson et al. | 428/102 |
| 5,156,171 A | | 10/1992 | Goodman | 132/200 |
| 5,379,782 A | | 1/1995 | Tabb | 132/275 |
| 5,426,788 A | | 6/1995 | Meltzer | 2/171 |
| 5,727,574 A | | 3/1998 | Frye | 132/210 |
| 5,727,575 A | | 3/1998 | Rontal | 132/200 |
| 5,826,593 A | | 10/1998 | Haubrich | 132/128 |
| 5,837,622 A | | 11/1998 | Hamilton | 442/184 |
| 6,047,708 A | | 4/2000 | Panel | 132/273 |
| 6,076,532 A | | 6/2000 | Thomas | 132/273 |
| 6,263,885 B1 | | 7/2001 | Levy | 132/275 |
| 6,269,488 B1 | | 8/2001 | Jurgensen | 2/171 |
| 6,293,285 B1 | | 9/2001 | Schach | 132/200 |
| 6,295,992 B1 | | 10/2001 | Sapp | 132/200 |
| 6,334,450 B1 | | 1/2002 | Collis | 132/210 |
| 6,435,194 B1 | * | 8/2002 | Babay | 132/275 |

* cited by examiner

*Primary Examiner*—Kevin Shaver
*Assistant Examiner*—Robyn Doan
(74) *Attorney, Agent, or Firm*—Drinker Biddle & Reath LLP

(57) ABSTRACT

A ponytail holder with an inner elastic band and an outer cushioning sleeve. The sleeve is made from at least two fabrics, one of which has a lower coefficient of friction than the other. The lower frictional fabric is located on the inner portion of the ponytail holder and contacts the wearer's hair. The sleeve's outer portion is made from a more absorbent fabric that can be printed upon more easily than the inner portion.

18 Claims, 4 Drawing Sheets

PONYTAIL HOLDER WITH LOW FRICTION INTERIOR PORTION

FIELD OF THE INVENTION

The present invention relates to ponytail holders and, more particularly, an improved ponytail holder that minimizes tangling and damage to hair, while providing a surface that accepts printed indicia.

BACKGROUND OF THE INVENTION

Prior to the introduction of the ponytail holder commonly called the "scrunchie" (Des. Pat. No. 292,030 shown in FIG. 1), hair was commonly held back with rubber bands or tightly wound elastic bands joined at their ends with a crimped piece of metal. These devices would typically become tangled in the hair making removal difficult. People with brittle hair or hair made weaker by medical conditions suffered from even greater hair loss when using these products, as their hair fell out or broke easily.

The scrunchie ponytail holder overcame this problem by placing a soft cushioning layer of fabric over an elastic band. The cushioning minimized damage to the hair while the elastic band kept the hair pulled tightly together. The result was a revolutionary device that minimized tangles and damage to the hair when removing the scrunchie ponytail holder.

It has also been determined that the fabric used to form the cushioning material can have an effect on snagging of the user's hair. Specifically, conventional plain weaves can cause high friction between the fabric and the hair, especially curly hair, which can lead to snagging and damage. To overcome this problem, satin woven fabrics like silk can be used to decrease friction between the ponytail holder and the wearer's hair. However, such fabrics have their own drawbacks. For example, it is difficult to print designs and patterns on satin fabrics. Printed designs are very desirable since they allow an otherwise bland ponytail holder to become a unique and eye-catching accessory.

A need, therefore, exists to have a ponytail holder that cushions the band from the hair, has decreased friction with the hair, and upon which a pattern may be printed.

SUMMARY OF THE INVENTION

A ponytail holder is disclosed which cushions the band from the hair while providing decreased friction with the hair and yet can be printed upon. The ponytail holder cushions the hair from the band by enclosing the band in an oversized sleeve of fabric. The oversized sleeve protects the hair from the point stress induced by a thin elastic band. The sleeve is made from at least two fabrics, one of which has a lower coefficient of friction than the other. The slipperier fabric is the inner portion of the ponytail holder which is the portion of the holder that contacts the wearer's hair. Finally, the sleeve's outer fabric is made from a less slippery fabric that can be printed upon more easily than the inner portion.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE FIGURES

For the purpose of illustrating the invention, there is shown in the drawings a form which is presently preferred; it being understood, however, that this invention is not limited to the precise arrangements and methodologies shown.

DETAILED DESCRIPTION OF THE DRAWINGS

Figure 1:
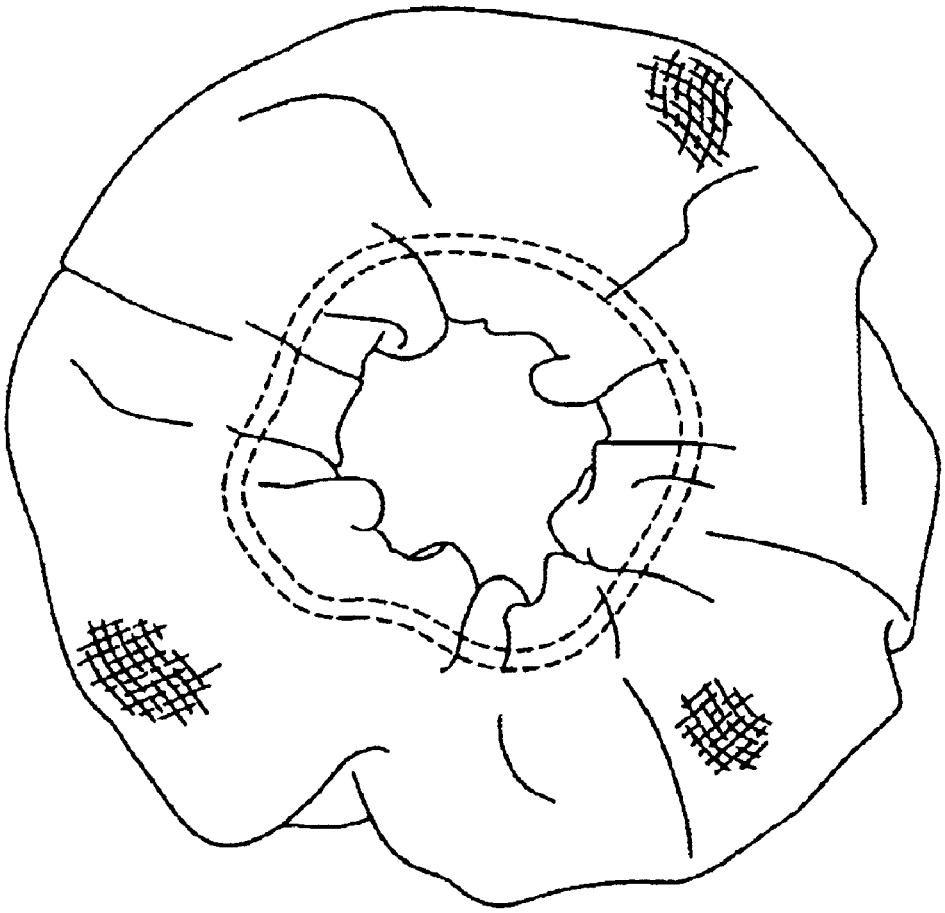
FIG. 1 (Prior Art)
FIG. 1 is a top view of a prior art holder for ponytails.
Figure 2:
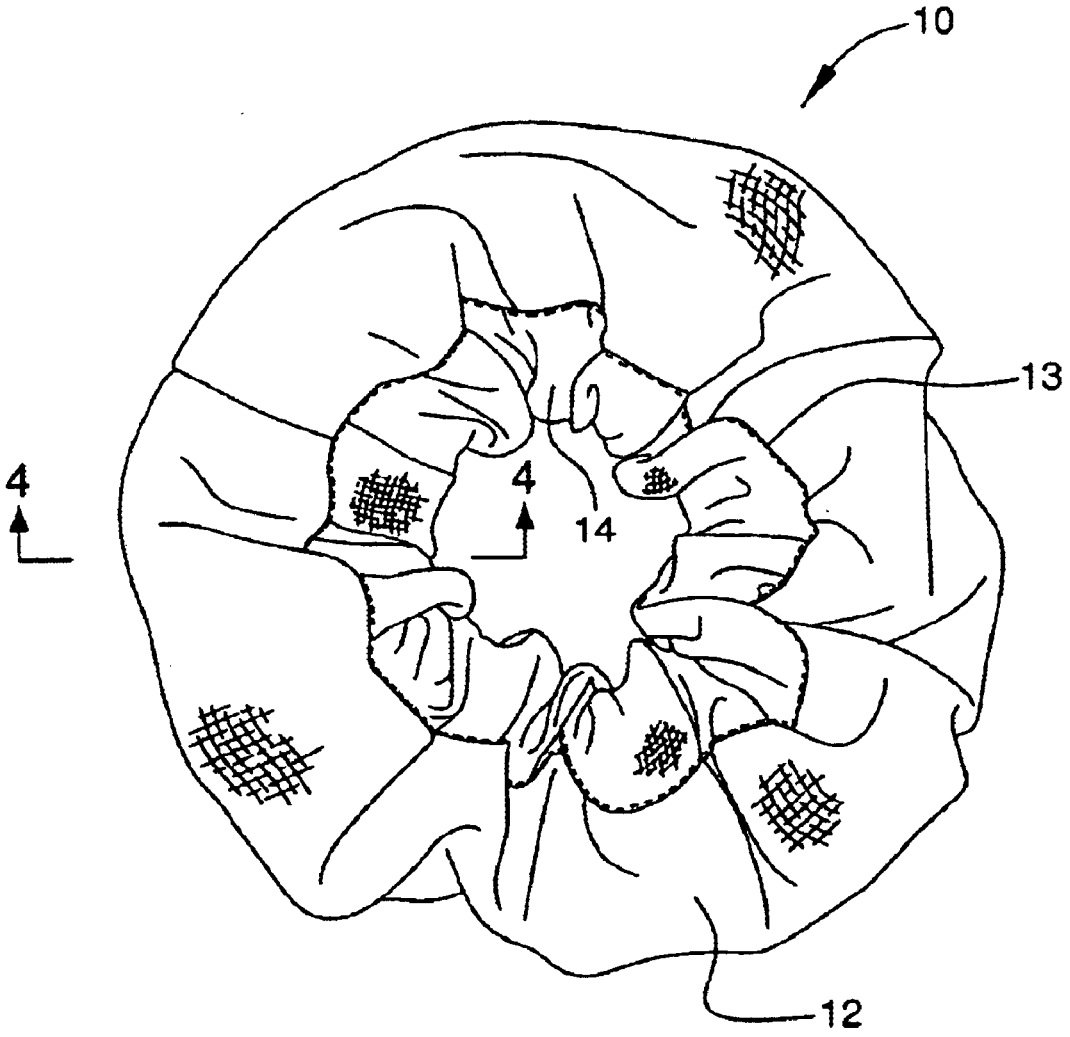
FIG. 2 is a top view of a ponytail holder according to the present invention.

Referring to the drawings, wherein like reference numerals illustrate corresponding or similar elements throughout the several views, FIG. 2 shows the inventive ponytail holder 10. Its shape is generally that of the prior art scrunchie ponytail holder. The ponytail holder 10 has an inner portion made of a first fabric 14 and an outer portion made of a second fabric 12. The first and second fabrics are joined together at their respective borders or edges 13, preferably by stitching the fabrics together. Together the first and second fabrics form the cushioning sleeve. Other methods for joining the fabrics, such as using an adhesive, could be substituted for the stitching. However, stitching is preferred since it maintains the flexibility of the sleeve.

Figure 6A:
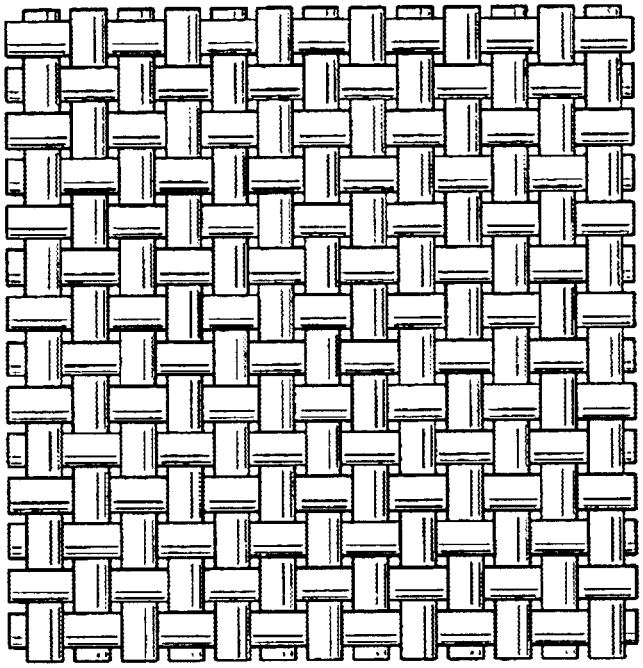
FIGS. 6*a* and 6*b* are enlargements of the thread pattern for a satin weave and a plain weave.
Figure 6B:
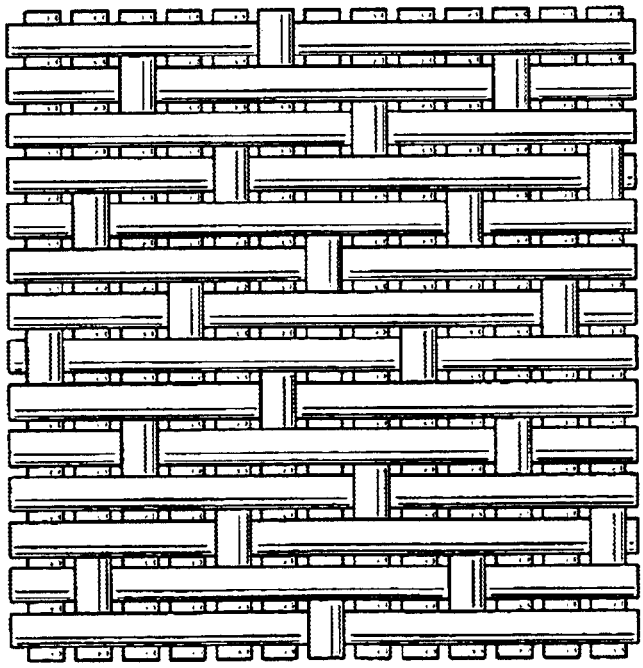

The fabrics used are selected such that the coefficient of friction for the first fabric 14 is less than the coefficient of friction for the second fabric 12. As such, the first fabric is slipperier than the second fabric. The advantage of the slippery first fabric 14 is that it minimizes snagging or tangling with its user's hair as compared with a rougher fabric. Fabrics using a satin weave such as silk, rayon, brocade, brocatelle, damask, and duvetyn are best suited for the first fabric 14. The primary reasons these are slippery is that they include long "floats". That is, the threads running in a certain direction overlie groups of cross-threads. For example, many satin weaves include threads that overlie 5 or more cross-threads. This can readily be seen in FIG. 6*b* which is an enlargement of a thread pattern in a satin material. FIG. 6*a* illustrates the thread pattern in a conventional plain weave. The longer floats in the satin weave result in a smoother contact surface between the material and the hair. However, the long floats in a satin weave also reduce the ability of the material to absorb printing inks. Thus, satin material is difficult to apply printing to.

The second fabric 12 is ideally made from a fabric that a pattern can be easily printed upon, for example a material which is more absorbent. Materials best suited for the second fabric are batiste, broadcloth, cambric, chambray, dimity, flannel, muslin, nainsook, organdy, poplin, viole, linen, albatross, balmacaan, chiffon, habutai, ninon, denim, cassimere, and tweed.

Figure 3:
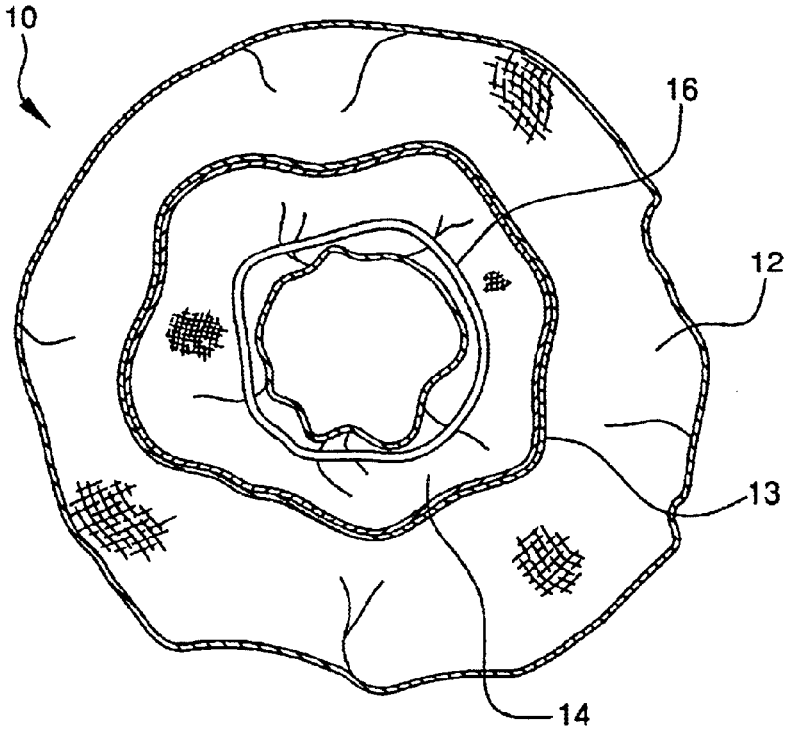
FIG. 3 is cross section of the top view of the inventive ponytail holder.

FIG. 3 shows a cross-section of the ponytail holder. The cross-section shows the elastic band 16 contained within the sleeve. This band secures the ponytail holder to its wearer's hair. Enclosing the band 16 within the sleeve distributes the band's 16 point force though the cushioning sleeve. The cushioning is further enhanced if the sleeve is longer than the elastic band, which causes the inelastic sleeve to "bunch" up when wrapped around the elastic band. The preferred ratio of the length of the sleeve to the length of the unextended elastic band is approximately 4:1. This prevents the band from exerting too great a point force on a person's ponytail.

Figure 4:
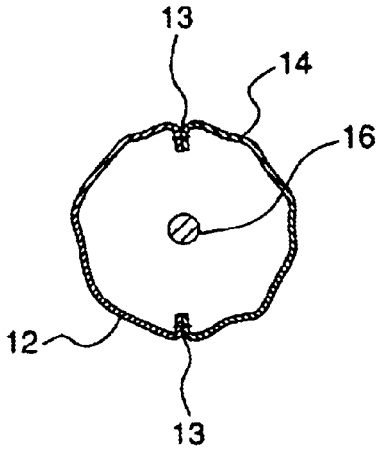
FIG. 4 is a cross sectional view of the inventive ponytail holder taken along lines 4—4 of FIG. 2.

FIG. 4 is a cross section of the embodiment of the inventive ponytail shown in FIG. 2. As can be seen in FIG. 4, the interior edges 13 between the fabrics are joined together, preferably using a stitched joint. As shown in FIG. 4, the band 16 is adjacent to the first fabric 14.

Figure 5:
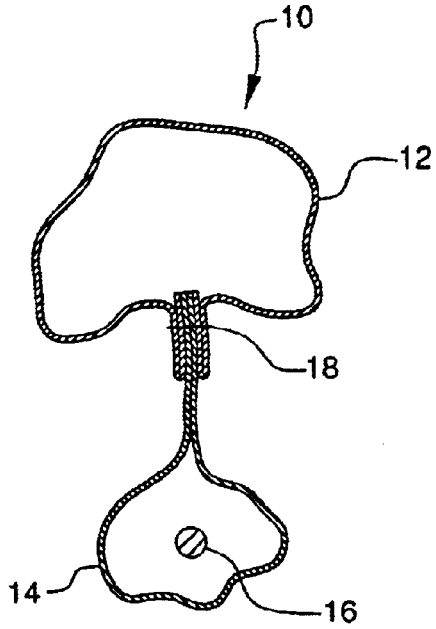
FIG. 5 is a cross sectional view of an alternate embodiment of the inventive ponytail holder of FIG. 4.

In an alternate embodiment shown in FIG. 5, the first and second fabrics fold onto themselves. The elastic band 16 is contained within the first fabric's 12 fold, and the edges of the first fabric are lined up just inside the edges of the second fabric's 12 fold. Once the edges line up, a stitch 18 or other joining means runs through the fabrics to join them. In this embodiment, the stitching of the two fabrics secures the band within by a second stitch. The advantage of maintaining the band 16 within the slipperier first portion 14 is to ensure that the slipperier first portion 14 remains in contact with its wearer's hair, thus minimizing damage.

Although a variety of different widths of material can be used, it has been determined that a ratio of the widths of the second (outer) fabric to the first (inner) fabric of approximately 3.1 provides a sufficient amount of low friction material for contacting the wearer's hair while providing a large surface of the second fabric for printing. However, ratios of 1:1 and 2:1 are also contemplated.

Although embodiments of the invention have been described in detail, it is understood that the invention is not limited thereto, and that various changes can be made therein without departing from the spirit and scope of the invention, which is defined by the attached claims.

What is claimed is:

1. A ponytail holder comprising:

an elastic band, and a fabric sleeve having an inner portion and outer portion, the inner portion made from a first fabric and the outer portion made from second fabric, the sleeve having a hollow core that contains the elastic band, the sleeve forming a generally circular shape, the first fabric having a lower coefficient of friction than the second fabric.

2. The ponytail holder of claim 1, wherein the ratio of the length of the elastic band in its non-extended state to that of the sleeve is approximately 1:4.

3. The ponytail holder of claim 1, wherein the first fabric is a satin weave.

4. The ponytail holder of claim 1, wherein the first fabric is selected from the group consisting of silk, rayon, brocade, brocatelle, damask, and duvetyn.

5. The ponytail holder of claim 1 wherein the second fabric is selected from the group consisting of batiste, broadcloth, cambric, chambray, dimity, flannel, muslin, nainsook, organdy, poplin, viole, linen, albatross, balmacaan, chiffon, habutai, ninon, denim, cassimere, and tweed.

6. The ponytail holder of claim 1, wherein the first fabric is selected from the group consisting of silk, rayon, brocade, brocatelle, damask, and duvetyn and wherein the second fabric is selected from the group consisting of batiste, broadcloth, cambric, chambray, dimity, flannel, muslin, nainsook, organdy, poplin, viole, linen, albatross, balmacaan, chiffon, habutai, ninon, denim, cassimere, and tweed.

7. The ponytail holder of claim 1, wherein the first fabric is a satin weave, and the second fabric has an ink printed pattern thereon.

8. The ponytail holder of claim 1, wherein the first fabric is less absorbent than the second fabric.

9. The ponytail holder in claim 1, wherein the ratio of the width of the first fabric to second fabric in the sleeve is approximately 1:3.

10. The ponytail holder in claim 1, wherein the ratio of first fabric to second fabric in the sleeve is approximately 1:2.

11. The ponytail holder in claim 1, wherein the ratio of first fabric to second fabric in the sleeve is approximately 1:1.

12. The ponytail holder of claim 1, wherein the elastic band is contained within the inner portion of the sleeve.

13. The ponytail holder of claim 12, wherein the elastic band is contained within the inner portion of the sleeve by stitching that runs the length of the sleeve.

14. A ponytail holder comprising:

an elastic band; and a fabric sleeve surrounding the elastic band, the sleeve forming a generally circular shape, the sleeve having an inner portion and an outer portion, the inner portion made from a satin weave material, and an outer portion made from fabric which is more absorbent than the inner portion, the inner portion being attached to the outer portion.

15. The ponytail holder of claim 14 wherein the elastic band is located adjacent to the inner portion.

16. A ponytail holder comprising:

a fabric sleeve inner and outer portions respectively made from first and second fabrics, the first fabric folded upon itself and secured such that an enclosed interior is defined by the first fabric that is separated from the second fabric; and an elastic band located with the enclosed interior defined by the first fabric.

17. The ponytail holder according to claim 16, wherein the first fabric has a coefficient of friction that is less than a coefficient of friction of the second fabric.

18. The ponytail holder according to claim 16, wherein the first fabric is less absorbent than the second fabric.

* * * * *